US005306179A

United States Patent [19]

Korenowski

[11] Patent Number: 5,306,179

[45] Date of Patent: Apr. 26, 1994

[54] LAMP BASE AND METHOD OF FORMING SAME

[75] Inventor: Nicholas E. Korenowski, Newbury, Ohio

[73] Assignee: General Electric Company, Schenectady, N.Y.

[21] Appl. No.: 44,673

[22] Filed: Apr. 9, 1993

[51] Int. Cl.[5] ..... H01J 9/36

[52] U.S. Cl. ..... 439/615; 439/874; 219/56.22; 219/93; 228/180.5; 445/27

[58] Field of Search ..... 445/27; 439/615, 874; 219/56.22, 93; 313/318; 228/180.5

[56] References Cited

U.S. PATENT DOCUMENTS

| | | | |
|---|---|---|---|
| 1,390,596 | 9/1921 | Thornton, Jr. | 439/874 |
| 2,066,317 | 1/1937 | Blake et al. | 439/615 |
| 2,325,817 | 8/1943 | Watrous, Jr. | 313/318 |
| 2,336,529 | 12/1943 | Cartun | 439/615 |
| 2,403,137 | 7/1946 | Strickland | 439/615 |
| 2,732,532 | 1/1956 | Tamis | 439/615 |
| 2,736,873 | 2/1956 | Bechard et al. | 439/615 |
| 2,999,220 | 9/1961 | Werner | 313/318 X |
| 3,147,361 | 9/1964 | Franke | 219/93 |
| 3,629,640 | 12/1971 | Audesse et al. | 313/318 |
| 3,775,634 | 11/1973 | Hasell et al. | 439/615 X |
| 4,866,331 | 9/1989 | Livera | 313/318 |

FOREIGN PATENT DOCUMENTS 488202 7/1938 United Kingdom .

*Primary Examiner*—Kenneth J. Ramsey
*Attorney, Agent, or Firm*—Edward M. Corcoran; George E. Hawranko; Stanley C. Corwin

[57] ABSTRACT

A base assembly and method of forming the base assembly for a lamp includes an annular eyelet having an axially outward extending protrusion. The lead wire is fed through the eyelet and folded across the protrusion while a contact member sandwiches the lead wire and confines it during a welding operation. The eyelet, contact, and lead wire are thus fusion bonded to provide a solder-free connection.

20 Claims, 1 Drawing Sheet

Fig. 1
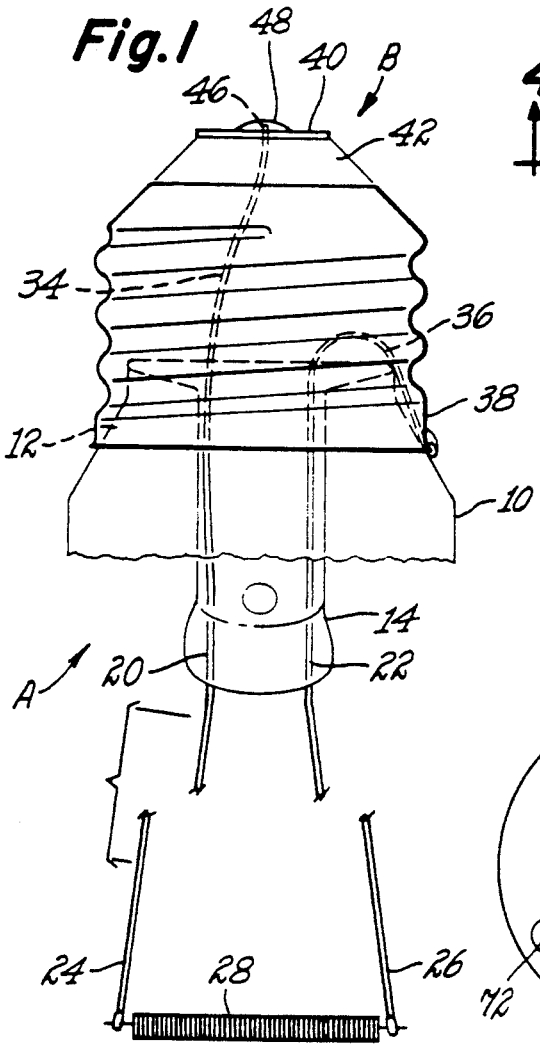
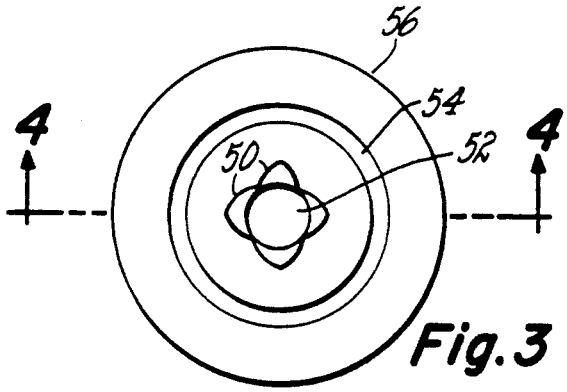
Fig. 3
Fig. 4
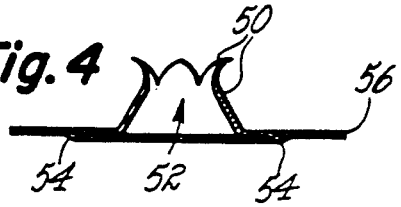
Fig. 5
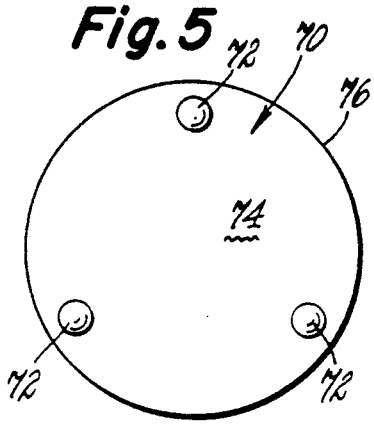
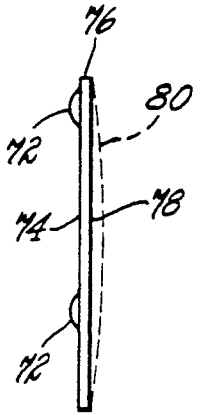
Fig. 6
Fig. 2
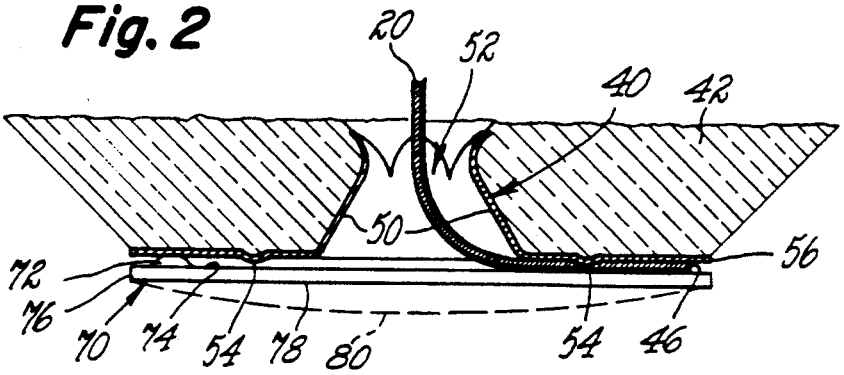

LAMP BASE AND METHOD OF FORMING SAME

BACKGROUND OF THE INVENTION

This invention pertains to the art of electric lamp assemblies, and more particularly to a base portion for a lamp. The invention is applicable to any lamp employing a metal screw base and will be described with particular reference thereto. However, it will be appreciated that the invention has broader applications and may be employed in similar environments and applications.

Incandescent lamp assemblies typically solder a terminal end of a lead wire to an electrical contact or eyelet. Recent and expected governmental regulations are designed to encourage a modification of this well known lamp construction and result in new designs and manufacturing processes that eliminate or reduce the use of solders and fluxes. For example, lead-free solders have undergone recent development in an attempt to address the required reduction in the use of lead-based solders. Even then, other elements incorporated into lead-free solders do not adequately meet selected requirements for lamps, such as severe lamp temperature applications. Moreover, still other components in the lead-free solders are expected to be targeted for reduction or elimination in the future.

Although other solder free connections between a lamp lead wire and an eyelet have been proposed, these arrangements often require substantial modification of the equipment that is currently used to produce and assemble the lamp base components. Thus, it is deemed desirable to meet these needs without undue modification or alteration of existing equipment.

Moreover, other suggested arrangements for connecting lamp lead wires to the eyelet still result in an assembly in which the connection is potentially exposed and left unprotected. A soldered connection not only provided a sound mechanical/electrical connection, but additionally offered some limited protection to the lead wire/eyelet connection.

SUMMARY OF THE INVENTION

The present invention contemplates a new and improved lamp base assembly and method of forming same that overcomes the above-referenced problems and others and provides a simple, economical arrangement that uses current manufacturing equipment without substantial modification.

According to the present invention, there is provided a lamp base assembly comprising an eyelet receiving a lead wire therethrough. The lead wire is bent over and pressed against a protrusion extending from the eyelet. A contact sandwiches the lead wire between it and the eyelet, and the combined assembly of the eyelet, contact, and lead wire is fusion bonded together.

According to a preferred arrangement, the protrusion is defined by a circumferentially continuous raised portion and the contact includes spaced projection tabs that engage the eyelet.

A principal advantage of the invention is the ability to provide a secure electrical and mechanical contact between the lead wire and eyelet.

Another advantage of the invention is the protection of the electrical/mechanical connection offered by the contact.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein:

FIG. 1 shows a prior art lamp base assembly with selected portions broken away and other portions shown in phantom to illustrate the general environment of the subject invention, FIG. 2 is an enlarged cross-sectional view of a modified lamp base assembly formed in accordance with the subject invention;

FIG. 3 is a plan view of the annular eyelet used in the lamp base assembly of FIG. 2;

FIG. 4 is a cross-sectional view taken generally along lines 4—4 of FIG. 3;

FIG. 5 s a plan view of the contact used in the lamp base assembly of FIG. 2; and, FIG. 6 illustrates the contact of FIG. 5.

DETAILED DESCRIPTION OF THE PREFERRED EMBODIMENT AND METHOD

Referring now to the drawings wherein the showings are for purposes of illustrating the preferred embodiment and method of the invention only, and not for purposes of limiting same, the FIGURES show a lamp A including a lamp base assembly B. More particularly, and with reference to the prior art arrangement of FIG. 1, the lamp includes an envelope or bulb 10 which is shown broken away but which typically has a generally spherical conformation. The bulb has a necked down region 12 received in the base assembly B and secured therein by cement means (not shown). A glass stem 14 is sealed to the end of bulb 10 by means of a flare at one end, with the other end supporting a pair of lead wires 20, 22 hermetically sealed in the stem by a pinch seal. The lead wires, in turn, support opposite ends of a filament 28 at their innermost ends 24, 26. As is well known, the filament is typically coiled and usually formed from a tungsten wire, the particular details of which form no part of the subject invention so that further discussion herein is deemed unnecessary.

Second or outer ends 34, 36 of the respective lead wires 22, 22 proceed outwardly from the glass stem for connection with contact portions 38 and 40 of the lamp base. As shown, the contact portion 38 is comprised of a generally cylindrical metal shell that includes external screw threads for mounting the lamp into an associated socket (not shown). The second contact portion 40 is an annular metal eyelet and is electrically insulated and physically separated from the first contact portion 38 by an insulating material 42, such as glass. A terminal end 46 of the first lead wire 20 is typically soldered as shown at 48 to the annular eyelet. The second lead wire is connected to the threaded contact portion 38 by soldering or welding.

The present invention modifies the conventional lamp base assembly and is best illustrated in FIG. 2. There, the base assembly has been inverted and like numerals refer to like elements, while new numerals refer to new elements. The metal annular eyelet 40 is integrally molded into the insulating material 42. The eyelet includes axially extending flanges 50 that together define an aperture 52 through which the lead wire 20 extends. As best shown in FIGS. 2 and 4, the flanges extend toward the bulb 10 and are thus received and integrally molded in the insulating material. As described to this point, the annular eyelet is of conventional construction.

The eyelet is modified by incorporating a protrusion 54 which, as best illustrated in FIG. 3, is a circumferentially continuous ridge spaced radially outward from the opening 52 and radially inward from a peripheral edge 56 of the eyelet. The protrusion extends axially away from the bulb a predetermined dimension, for example for a standard medium screw base design, on the order of 0.009–0.010 inches. Of course the invention is equally applicable to other base types and sizes. Generally, the dimensions can be proportioned for other sizes by providing an axial protrusion on the order of 0.25 to 1.0 times the diameter of the lead wire 20.

The terminal end 46 of the second lead wire is extended through the opening 52 a predetermined length so that when folded or bent over into engagement with the surface of the eyelet, it does not extend beyond the periphery 56 of the eyelet. Moreover, by providing a circumferentially continuous protrusion, the orientation of the eyelet relative to the lead wire is not critical since it will overlie the protrusion 54 in any radial direction.

With continued reference to FIG. 2, and additional references to FIGS. 5 and 6, a circular contact member 70 will be described in greater detail. Preferably, the contact is a brass or brass plated material such as nickel that is coined to provide multiple projection tabs 72 in spaced relation and that extend axially from a first surface 74. The projection tabs extend a predetermined dimension from the first face 74. By way of example only, the tabs extend from the face on the order of 1.0 to 2.0 times the diameter of the lead wire 20 and are oriented for contact with the eyelet at an area spaced radially outward from the protrusion 54. Multiple tabs (three shown in FIG. 5) are preferred to assure good electrical and mechanical contact between the eyelet and contact member 70. The periphery 76 of the contact is substantially the same dimension as the outer periphery 56 of the eyelet. Moreover, a second surface 78 may be optionally configured as a raised dome 80, as shown in broken line. The optional domed surface promotes good electrical contact with the lamp socket.

The contact 70 is advanced into facing relation with the eyelet, confining or sandwiching the terminal end 46 of the second lead wire therebetween. The projection tabs 72 provide a precise spacing between the eyelet and contact so that when the eyelet is electrically grounded by means of a shoe (not shown) contacting the eyelet, and electrical current provided through a welding head (not shown), a sound electrical/mechanical connection between the eyelet and lead wire is formed, as well as multiple electrical and mechanical connections between the eyelet 40 and contact member 70. The protrusion 54 develops a local, high resistance region that assures a sound fusion bonding between the lead wire and eyelet, while high contact resistance is developed between eyelet 40 and projection tabs 72. Additionally, the contact member protects the lead wire and eyelet connection, a feature not provided by other known arrangements.

This method completely eliminates the need for either lead-based or lead-free solder. Additionally, the fusion bonded or welded arrangement eliminates the need for a flux and the environmental concerns associated therewith. Further, the arrangement uses existing equipment and components with little or no modification.

The invention has been described with reference to the preferred embodiment and method. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A method of forming a base of an electrical lamp comprising the steps of:

providing an annular base eyelet adapted to be secured to a glass insulation of said lamp;

forming a protrusion in said eyelet to extend from one face thereof;

advancing a lead wire through said eyelet and deforming said lead wire over said protrusion;

providing a contact in facing relation with said eyelet and receiving said lead wire therebetween; and fusion bonding said contact and said eyelet together.

2. A method as defined in claim 1 wherein said protrusion forming step includes forming a circumferentially continuous protrusion in said eyelet.

3. A method as defined in claim 1 comprising the further step of forming an axially extending projection in said contact.

4. A method as defined in claim 3 wherein said projection forming step includes forming plural, generally equally spaced projections in said contact.

5. A method as defined in claim 1 comprising the further step of providing a convex surface on said contact.

6. A method as defined in claim 5 wherein said convex surface providing step includes providing said convex surface on a face of said contact opposite said eyelet.

7. A method as defined in claim 1 comprising the further steps of providing a convex surface on one face of said contact and forming an axially extending projection on the opposite face of said contact.

8. A base assembly for a lamp comprising:

an annular eyelet having a protrusion extending axially outward from a first face thereof;

a lead wire extending axially through said eyelet and radially over said protrusion;

a contact disposed adjacent said first face of said eyelet and axially confining said lead wire between said contact and eyelet; and said eyelet, contact and lead wire being fusion bonded together to provide a solder-free connection.

9. A base assembly as defined in claim 8 wherein said protrusion of said eyelet is circumferentially continuous.

10. A base assembly as defined in claim 8 wherein said contact includes at least one projection tab extending toward said eyelet.

11. A base assembly as defined in claim 10 wherein said contact includes plural projection tabs circumferentially spaced about said contact.

12. A base assembly as defined in claim 10 wherein said contact includes a domed surface extending axially outward from a face opposite said projection tab.

13. A base assembly as defined in claim 8 wherein said eyelet includes a circumferentially continuous protrusion extending axially outward toward said contact and plural tabs projecting from said contact toward said eyelet.

14. A base assembly as defined in claim 13 wherein said protrusion extends axially a lesser dimension than said tabs.

15. A base assembly of a lamp having an eyelet through which a lead wire extends from an interior of said lamp, and a contact confining a terminal end of said lead wire between said eyelet and contact, and a fusion bond of said eyelet and lead wire to provide a solder free connection.

16. A lamp base assembly as defined in claim 15 further comprising a protrusion extending outwardly from said eyelet toward said contact and a projection tab extending axially from said contact toward said eyelet.

17. A lamp base assembly as defined in claim 16 wherein said protrusion extends axially a lesser dimension than said projection tab.

18. A lamp base assembly as defined in claim 16 wherein said protrusion is circumferentially continuous.

19. A lamp base assembly as defined in claim 16 wherein said contact includes plural projection tabs circumferentially spaced at a region radially outward of said protrusion.

20. A lamp base assembly as defined in claim 16 wherein said contact includes a domed surface extending axially outward from a face opposite from said eyelet.

* * * * *